US006122381A

United States Patent [19]

Winterer

[11] Patent Number: 6,122,381

[45] Date of Patent: Sep. 19, 2000

[54] STEREOPHONIC SOUND SYSTEM

[75] Inventor: Martin Winterer, Gundelfingen, Germany

[73] Assignee: Micronas Interuetall GmbH, Freiburg, Germany

[21] Appl. No.: 08/854,922

[22] Filed: May 13, 1997

[30] Foreign Application Priority Data

May 17, 1996 [EP] European Pat. Off. ..... 96107860

[51] Int. Cl.[7] ..... H04R 5/00

[52] U.S. Cl. ..... 381/17; 381/1

[58] Field of Search ..... 381/1, 17, 18, 381/22, 23, 24, 307, 310, 27

[56] References Cited

U.S. PATENT DOCUMENTS 3,745,254 7/1973 Ohta et al. .
4,408,095 10/1983 Ariga et al. .
5,412,731 5/1995 Desper .

FOREIGN PATENT DOCUMENTS 0608930 1/1994 European Pat. Off. .
0630168 6/1994 European Pat. Off. .
0637191 7/1994 European Pat. Off. .
4030121 9/1990 Germany .

OTHER PUBLICATIONS

Carstens, "Effekthascherei", ELRAD, vol. No. 7, pp. 76–81, 1994.

Schroeder, "An Artificial Stereophonic Effect Obtained from a Single Audio Signal", JAES, vol. 6, No. 2, pp. 74–79, Apr. 1958.

European Search Report for 96107860.7, dated Apr. 11, 1996.

*Primary Examiner*—Vivian Chang

*Attorney, Agent, or Firm*—Arthur L. Plevy; Buchanan Ingersoll PC

[57] ABSTRACT

A stereophonic sound system is disclosed, having a source of stereophonic signals which contain a right signal and a left signal as well as further signals which supplement the right and left signals to convey a three-dimensional sound impression. The right and left signals are adapted to a stereo base of a pair of loudspeakers having a correspondingly small size by means of a modification circuit. Of the stereophonic signals, only the right and left signals are fed to the modification circuit so that they are falsified as little as possible. An improved system for conveying a three-dimensional sound impression is thus provided.

16 Claims, 3 Drawing Sheets

(PRIOR ART)

(PRIOR ART)

STEREOPHONIC SOUND SYSTEM

FIELD OF THE INVENTION

The present invention relates to a stereophonic sound system. In particular, the invention embraces a sound system that conveys an improved, three-dimensional sound impression with a small stereo base width, by providing a source of stereophonic signals which separately deliver at least one right signal and one left signal, as well as further signals which supplement the right and left signals.

BACKGROUND OF THE INVENTION

People enjoy stereo sound systems for many purposes, such as for use with radios, television, movies, or other forms of entertainment or business involving musical or audio reproductions. Stereo sound systems are now even at times used with computers. A three-dimensional sound effect is desirable with stereo-sound systems, as it improves the sound impression and enhances the listener's experience by providing the listener with a sound impression that more closely approximates a live performance as opposed to a reproduction, especially as compared with two-dimensional sound.

Several methods of producing a three-dimensional sound effect are known which use four different channels with associated loudspeakers. For example, a method known under the trade name "Dolby Pro Logic" is currently used in many audio systems, including systems used with luxury television receivers. In such systems, a three-dimensional sound impression is conveyed by providing a right channel, a left channel, a center channel, and a rear channel. The rear channel may also be referred to as the surround channel. This four-channel distribution system provides a good three-dimensional sound effect, particularly for sound signals which seem to be coming predominantly from the center region located in front of the listener. In many cases, the stereophonic signals are not formed from genuine spatial signals, but rather, they are derived by providing different existing versions of a single audio signal to left and right speakers (or the left and right ears of a listener), via filter circuits. In that case, a pseudostereophonic effect is obtained, which nevertheless enhances the listening experience.

The use of four or more loudspeakers is frequently not possible due to a lack of space or cost of the speakers. Methods are known whereby different stereophonic signals can be combined via filter circuits to provide a satisfactory spatial effect with a reduced number of loudspeakers. In a certain sense, these methods represent a reversal of the above-mentioned pseudosystem.

An example of such methods is discussed in European Patent Application No. 94,305,664.8 (publication no. 0 637 191 A2), filed Jul. 29, 1994 by Lida Toshiyuki, et als., entitled SURROUND SIGNAL PROCESSING APPARATUS. The Toshiyuki application discloses a surround signal processing apparatus with which the number of sound reproducers can be reduced without losing the three-dimensional impression. Instead of using four speakers, a three-dimensional effect can be provided with a minimum of a right and a left speaker (or sound reproducers). The signals of the missing sound reproducers are electronically superimposed on the signals of the existing sound reproducers; the missing signal paths to the listener's right and left ears are electronically simulated via filter and delay circuits and the existing sound paths.

In simpler stereophonic sound systems, the center speaker, which represents a sound source located in front of the listener, is frequently eliminated by evenly dividing the center signal between the right and left channels already within the associated stereo filter circuit. This mode of operation is generally referred to as the phantom mode. The mode without a central sound reproducer is especially suited for television applications, since even luxury television sets generally have only two built-in speakers for the right and left channels. A separate speaker for the center channel can hardly be implemented for structural reasons.

The phantom mode (the division of the center signal between the right and left channels) is, in fact, often favored for television applications, in light of the relatively closely-spaced sound reproducers of a television set and the sound event itself. For example, televisions frequently show events on the center screen, such as a news announcer, a dialog scene, or a music group—the event thus often corresponds to the acoustic center position.

However, during television reception, while basically good sound impression is obtained when sound events are centralized, this contrasts with a poorer sound impression for events that are more distributed, such as particularly decentralized, sound sources. This poorer sound impression is due to the relatively small distance—the stereo base—between the two built-in speakers for the right and left channels. As a rule, the available stereo base width does not correspond with the viewing distance.

Circuits have been developed to address the reduced sound quality attributable to a small stereo base. For example, a circuit with which the stereo base can be widened is disclosed in co-pending U.S. application Ser. No. 08/754,144, filed Nov. 22, 1996, by inventor Winterer (the inventor herein), entitled SIGNAL MODIFICATION CIRCUIT, and assigned to Deutsche ITT Industries, GmbH (the assignee herein), which further claims foreign priority based on European Patent Application No. 95,118,595.8, and is incorporated herein by reference. In that invention, the right and left signals are modified by means of suitable filter circuits prior to loudspeaker reproduction. The differences in the signal waveforms above approximately 300 Hz in the right and left channels are enhanced and the common signal components are attenuated. The common signal components represent essentially a center signal.

Additionally, in the journal "ELRAD," 1994, No. 7, pages 76 to 81, analog circuits are disclosed with which the stereo base width of right and left signals is increased. Also known and described are circuits for creating spatial effects; these use output signals from commercially available stereo processors to produce specific spatial effects via external filter circuits.

The disadvantage of the stereophonic sound systems described above is that by applying the phantom mode—i.e., during electronic simulation of sound reproducers in the center position—they, to some extent, falsify the center impression through their filter circuits. If the stereo base width is also increased, the center impression is impaired even more.

It is therefore an object of the present invention to provide a circuit for use with a stereophonic sound system that conveys an improved three-dimensional sound impression, particularly an improved center impression, while using a reduced number of sound reproducers and a correspondingly small stereo base width.

It is a further object of the invention to provide a source of stereophonic signals that does not operate in the phantom mode with respect to its output signals, but remains in the normal mode.

SUMMARY OF THE INVENTION

This invention embraces a circuit in which the right and left signals are adapted to the stereo base of a pair of loudspeakers by means of a stereo-base-widening modification circuit; however, only the right and left stereophonic signals from the source, which are falsified as little as possible, are fed to the modification circuit. All stereophonic signals, for example, the right and left signals, the center signal, and the surround signal, are delivered separately and, as far as possible, unchanged.

The right and left signals are fed to an external stereo-base-widening circuit (or modification circuit). The center channel is added to the modified right and left signals after those signals are delivered from the modification circuit. Through this separate processing, the center channel is no longer modified in the stereo-base-widening circuit with respect to its frequency-dependent signal components. Thus, the center impression remains independent of the stereo-base widening chosen.

In one embodiment, three speakers are used, such that the surround signal is delivered to the separate, third loudspeaker. In an alternative embodiment, only two speakers are used. The surround signal is fed to a filter circuit, which forms a pseudostereo signal having left and right components. Those components are then fed to modified left and right signals fed from the modification circuit.

BRIEF DESCRIPTION OF THE DRAWINGS

The invention and preferred embodiments thereof will now be explained in more detail with reference to the accompanying drawings, in which.

DETAILED DESCRIPTION OF THE INVENTION

Figure 1:
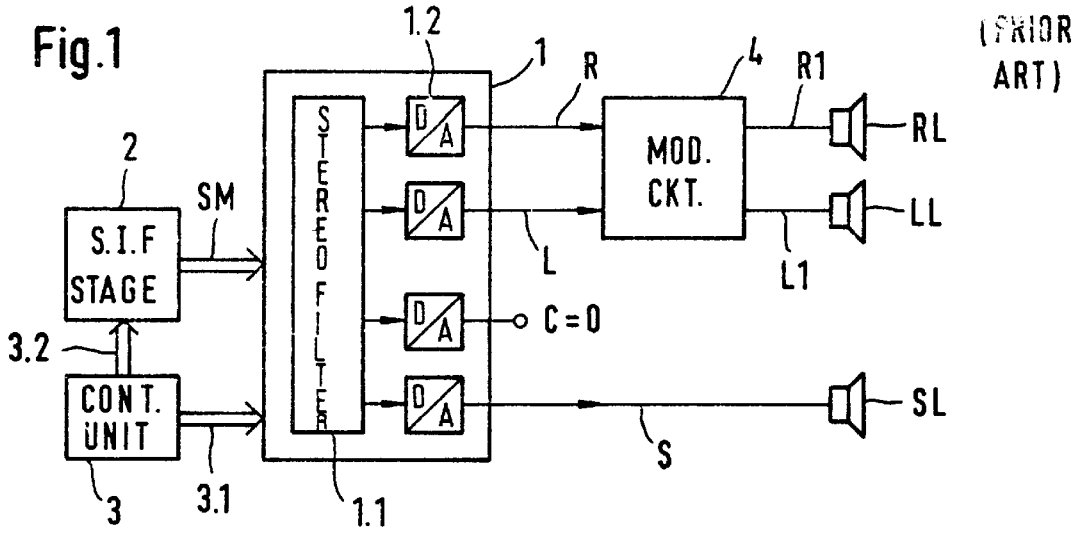
FIG. 1 is a block diagram of a conventional stereophonic sound system with three sound reproducers.

Referring to FIG. 1, there is shown a block diagram of a conventional stereophonic sound system. This system includes a source 1 of stereophonic signals in the form of, for example, a multichannel decoder (e.g., the above-mentioned Dolby Surround Pro Logic processor), which is well known and described. The source 1 provides a right signal R, a left signal L, a center signal C, and a surround signal S. A sound intermediate-frequency (SIF) stage 2 produces a stereo multiplex signal SM, which is delivered to a stereo filter circuit 1.1. The filter circuit 1.1 then forms the stereophonic signals R,L,C, and S. The signals produced by the SIF stage also may be genuine three-dimensional signals.

As a rule, the processing by the filter circuit 1.1 is digital, so that the individual signals have to be converted back to analog signal components by means of digital-to-analog converters 1.2. A control unit 3 controls both the source 1 and the SIF stage 2 by use of control signals 3.1 and 3.2, respectively. The control, of course, depends on whether the overall circuit is part of a television receiver or other equipment. With the control unit 3, it can also be predetermined how many sound reproducers, namely loudspeakers, are present or whether reproduction is to take place through headphones. In response to the control signal 3.1, the output signals from the filter circuit 1.1 are switched and adapted to the actual number of reproducers. In other words, the control signal can change the output signals of the filter circuit (R,L,C and S) to correspond to the number of loud speakers or other reproducers in use. A widely used mode of operation is the above-mentioned phantom mode, in which the center signal C is evenly divided between the right and left signals R, L. In that mode, the surround signal S is not affected.

When a stereo base is too narrow, this is compensated by a modification circuit 4. In the phantom mode, an "R+C" signal and an "L+C" signal are fed to the modification circuit. The center signal component C is also weighted in the stereo filter circuit 1.1 as a function of frequency. Thus, the output of the modification circuit 4 provides a modified right signal R1 and a modified left signal L1 which feed the right loudspeaker RL and the left loudspeaker LL, respectively. The surround signal S is reproduced by means of a separate loudspeaker SL, which is best placed behind the listener.

Figure 2:
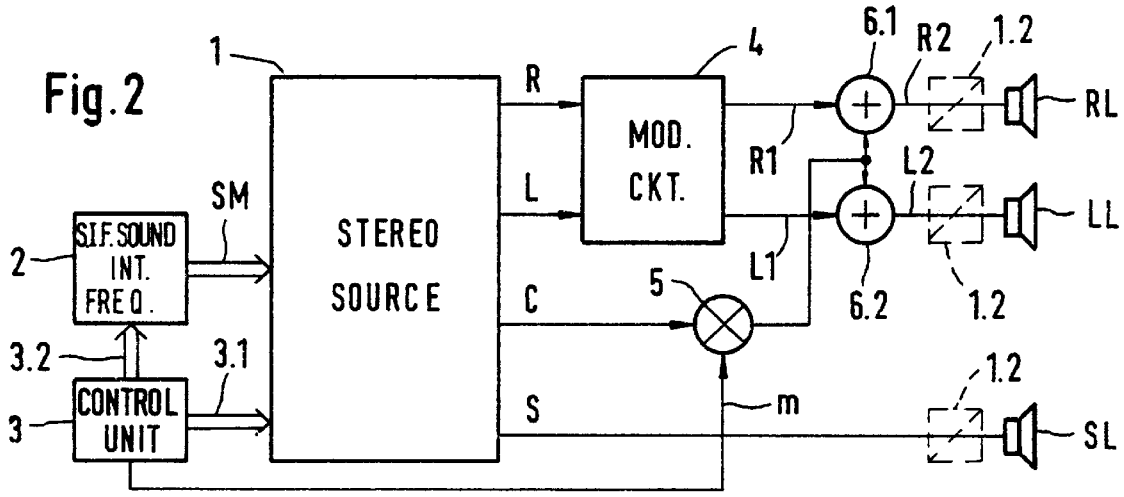
FIG. 2 is a block diagram of one embodiment of the present invention with three sound reproducers.

FIG. 2 shows a first embodiment of the invention in block-diagram form. Like reference characters have been used to designate functional units already described in connection with FIG. 1. Like in FIG. 1, the source 1 provides the stereophonic signals R, L, C, S as digital signals. Then, new digital-to-analog interfaces have to be defined in the respective signal paths. These are provided with digital-to-analog converters 1.2 disposed along each output path. Alternatively, digital-to-analog converters can be used with the source 1 via separate inputs. With the circuit disclosed in FIG. 2, even with the use of a reduced number of sound reproducers, the source 1 need no longer be switched to the phantom mode. Instead, all the signals R, L, C, and S are separately delivered from the source 1, and signal reduction takes place only after the right and left signals R and L, are processed by the modification circuit 4. The center signal C is weighted by means of a multiplier 5 and added to the modified right signal R1 via a first adder 6.1 and to the modified left signal L1 via a second adder 6.2. The new output signals R2 and L2 feed the right and left loudspeakers, RL and LL, respectively. The weighting of the center signal C is determined by a multiplication factor m delivered from unit 3.

This processing of the center signal C only after the right and left signals have passed through the modification circuit (4) is advantageous over the circuit of FIG. 1 in that stereo-base widening is accomplished using only the pure right and left signals R,L. Falsifications by the center signal C cannot occur before the modification circuit 4 performs the stereo-base widening. This is particularly important if the SIF stage 2 transmits not only a stereo multiplex signal SM but also a signal with genuine three-dimensional components.

Figure 4:
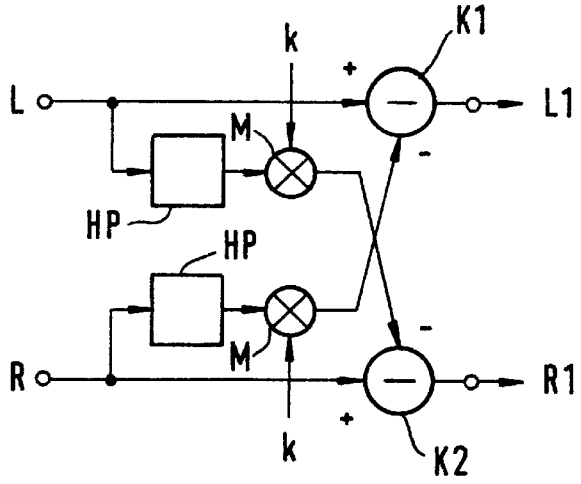
FIG. 4, 5 and 6 show circuits for electronically increasing the stereo base width (that may be used for the modification circuit 4 of FIGS. 2 and 3)
Figure 5:
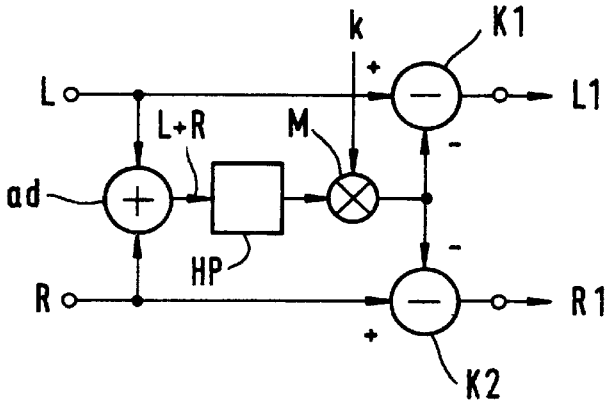
(PRIOR ART) Fig.5
Figure 6:
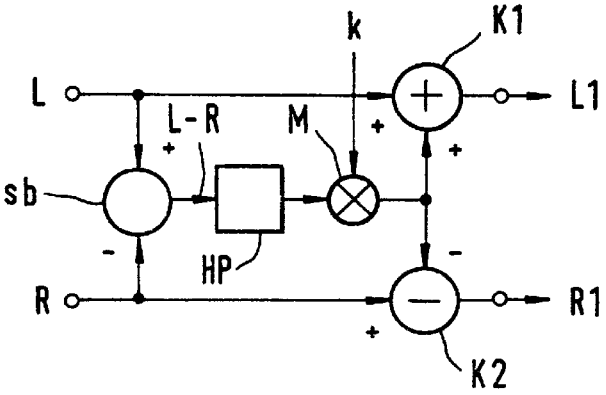
(PRIOR ART) Fig.6

For the stereo-base-widening modification circuit 4, conventional circuits are well known in the field and available. Such circuits are described, for example, in the above-mentioned journal "ELRAD." Additionally, the associated basic circuits that may be used with this invention are illustrated in FIGS. 4, 5, and 6, and further described below.

Figure 3:
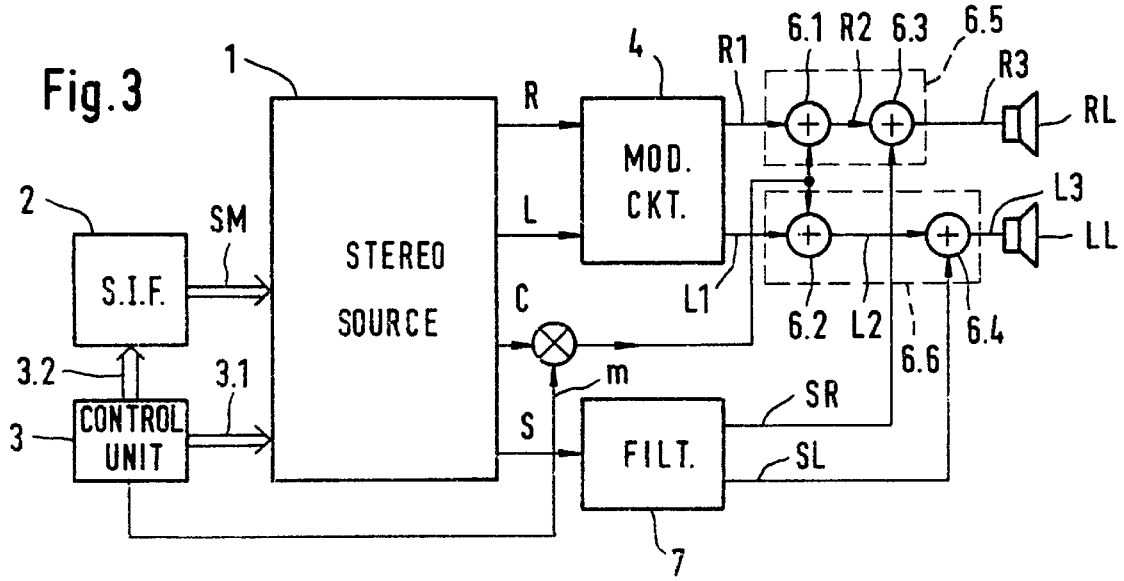
FIG. 3 is a block diagram of another embodiment of the present invention with two sound reproducers.

FIG. 3 shows another embodiment of the invention in which the number of sound reproducers is reduced to a single pair of loudspeakers RL, LL. This embodiment is especially suited for television receivers with a built-in right speaker and left speaker. Although the stereo base width is relatively small and no speaker for the surround signal is present, a satisfactory three-dimensional sound effect is obtained.

The circuit of FIG. 3 differs from the circuit of FIG. 2 in that the surround signal S is fed to a filter circuit 7. The filter circuit 7 forms a pair of pseudostereo signals from the surround signal S, having right and left components, SR and SL. The right component SR is added to the signal R2 for the right speaker RL by means of a third adder 6.3, and the left component SL of the modified surround signal is added to the signal L2 for the left speaker LL by means of a fourth adder 6.4. The order 6.5, 6.6 of the adders in each signal path for forming the right signal R3 and left signal L3, respectively, is arbitrary.

Figure 7:
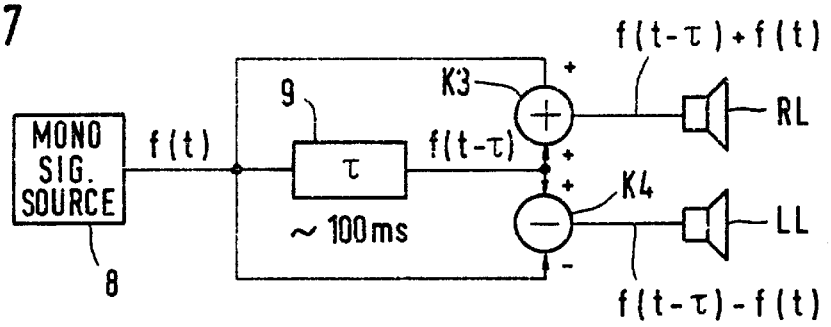
FIGS. 7, 8 and 9 are block diagrams of filter circuits for obtaining a pseudostereo signal from a monaural signal (that may be used for the filter circuit 7 of FIG. 3).

The filter circuit 7 for forming a pair of pseudostereo signals SR, SL from a single stereophonic signal S can be very simple, for example, as shown in FIG. 7. The circuit of FIG. 7 is known from a publication of The Audio Engineering Society entitled "Stereophonic Techniques—An Anthology of Reprinted Articles on Stereophonic Techniques" (New York, 1986), pages 64 to 69. This is a reprint of an article by M. R. Schroeder, "An Artificial Stereophonic Effect Obtained from a Single Audio Signal," JAES, Vol. 6, No. 2, pages 74 to 79 (April 1958). The same article also describes the improved circuits of FIGS. 8 and 9. The circuit of FIG. 7 is described in more detail below.

FIG. 4 shows the stereo-base-widening circuit of the stereo-modification circuit 4 of FIGS. 2 and 3. The directional effect for the left or right signal L1, R1 is enhanced by coupling the higher frequency components, which are important for the three-dimensional impression, into the respective other channel in antiphase. This coupling is effected through a first combination stage K1 and a second combination stage K2, respectively. The signal components are filtered by respective high-pass filters HP and weighted with the factor k by a multiplier M. The antiphase condition is established simply by implementing each of the two combiners K1, K2 with a subtracter whose subtrahend input is supplied with the high-pass-filtered signal from the opposite channel.

FIG. 5 shows another embodiment for the stereo-base-widening circuit 4. This circuit includes an adder (ad) whose output signal L+R is the sum of the left and right signals L, R. The sum value represents the signal component which actually does not contain any directional information. A signal component is determined from this sum value with a high-pass filter HP and a multiplier M, and subtracted from the right and left signals R, L. Each of the two modified stereo signals R1, L1 thus contains a smaller common signal L+R, so that the two signal sources seem to move apart without the actual positions of the loudspeakers being changed.

In FIG. 6, a difference signal L−R is formed from the right and left signals R, L by means of subtracter sb. The larger this signal, the more independent the two signals R, L will be. A high-pass-filtered component of this difference signal L−R is used to increase the independent left and right signal components in the respective signal paths in correct phase relation. This is accomplished with an adder K1 and a subtracter K2, respectively. Thus, in FIG. 6, too, an increase of the independent signal components in the two signal paths takes place, giving the listener the impression of an increased stereo base width.

FIG. 7, as noted above, exemplifies a filter circuit 7 of the circuit of FIG. 3. This is a prior art circuit which generates from the monaural signal f(t) of a signal source 8 a pair of pseudostereo signals which is reproduced by a right speaker RL and a left speaker LL. The signal f(t) is delayed by approximately $\tau$=100 ms in a delay element 9 and combined with the original sound signal f(t) in an adder K3. The output signal $f(t-\tau)+f(t)$ then feeds the right speaker RL. Analogously, the output signal $f(t-\tau)$ of the delay element 9 is combined with the original signal f(t) in a subtracter K4 to form a signal $f(t-\tau)-f(t)$, which feeds the left speaker LL.

The direction-dependent sound impression is created by simulating the desired directional impression. This impression is created by the signals modified by the delay element 9, in conjunction with the different sound propagation times to the listener's right and left ears.

Figure 8:
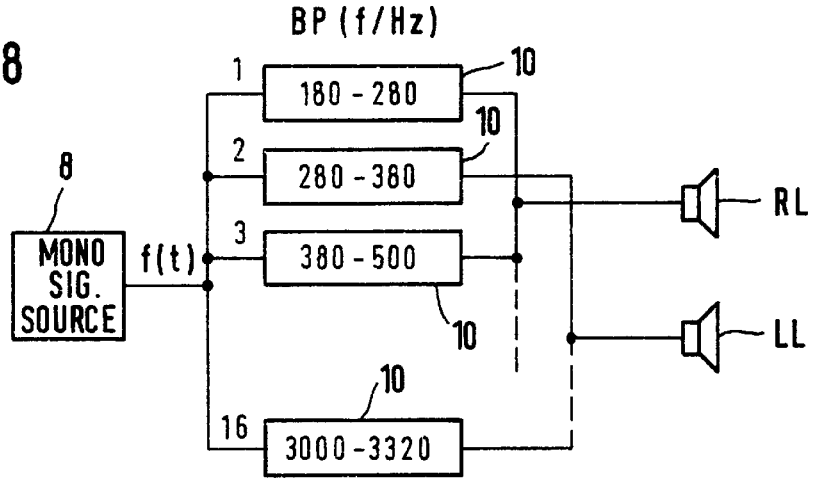
(PRIOR ART) Fig.8

FIG. 8 shows another known example of how a pair of pseudostereo signals can be formed from a monaural signal f(t) via a filter bank BP. The original signal f(t) is resolved into a sequence of separate frequency ranges via a plurality of narrow bandpass filters 10. The outputs of the successive bandpass filters, numbered in FIG. 8 from 1 to 16, are alternately connected to the right and left speakers RL, LL. In this manner, a directional effect is obtained again. The splitting into individual frequency ranges and their alternate assignment to the two loudspeakers is similar to that in the arrangement of FIG. 7, which also shows this splitting for all frequency multiples corresponding to the delay $\tau$=100 ms.

Figure 9:
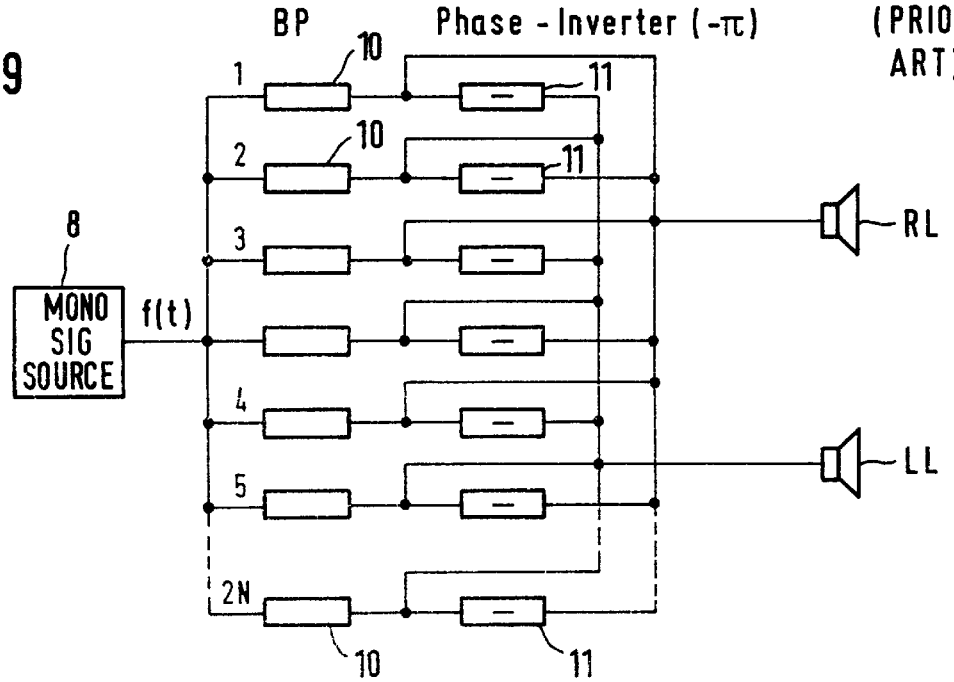
(PRIOR ART) Fig.9

In FIG. 9, the formation of the pseudostereo signal from the original signal f(t) was further refined by connecting phase inverters 11 to the outputs of the individual bandpass filters 10 of the filter bank BP. This arrangement makes it possible to connect each bandpass filter output to one of the two speakers RL, LL. However, the outputs are applied alternately through the respective phase inverters 11 associated with the respective bandpass filters 10. Through these measures, no frequency gaps like in the arrangements of FIGS. 7 and 8 occur in the pseudostereo signal, so that the sound impression is less falsified.

The circuits of FIGS. 7, 8 and 9, which only represent a selection of prior-art circuits, are described in the above reference as analog circuits. Their conversion to digital circuits is familiar to those skilled in the art and brings about the known advantages regarding stability. For the implementation of the stereophonic sound system, it is irrelevant whether the entire circuit or parts thereof are implemented in hardware and/or software.

It will be understood that the embodiments disclosed herein are exemplary, and one skilled in the art may make various modifications or variations to the invention without departing from the spirit or essential attributes of the invention. It is understood that all such modifications or variations are intended to be included within the scope of the following claims.

What is claimed is:

1. A stereophonic sound system comprising:

a source of stereophonic signals, the stereophonic signals comprising a right signal, a left signal, a center signal and a surround signal; and, a modification circuit for performing stereo-base widening of the right and left signals so that they may be fed to a pair of loudspeakers having a reduced stereo-base width;

wherein of the stereophonic signals delivered from the source, only the right and left signals are fed to the modification circuit so that the signals are falsified as little as possible; and, wherein said center signal is additively combined with said right and left signals after said right and left signals are fed from the modification circuit, such that the center signal in combination with the right and left signals forms a modified right signal and a modified left signal.

2. The stereophonic sound system of claim 1, further comprising a loudspeaker positioned at the rear of the listener for reproducing the surround signal.

3. The stereophonic sound system of claim 1, further comprising a filter circuit for forming a pair of pseudostereo signals from the surround signal, wherein the pseudostereo signals have right and left components that are combined with the modified right signal fed from the modification circuit and the modified left signal fed from the modification circuit, respectively.

4. A stereophonic sound system for conveying an improved three-dimensional sound impression, comprising a source for generating stereophonic signals, the stereophonic signals comprising a right signal, a left signal, a center signal, and a surround signal, wherein the center signal and surround signal supplement the right and left signals to convey a three-dimensional sound impression;

three sound reproducers for reproducing the sound impression generated by the stereophonic signals, comprising a pair of right and left sound reproducers and a separate reproducer;

a modification circuit for increasing the width of the right and left stereophonic signals before each signal is delivered to one of the pair of sound reproducers;

wherein all the stereophonic signals are separately delivered from the source in that the right and left signals are delivered from the source to the modification circuit, which produces modified right and left signals; the central signal is added to the modified right and left signals to produce new output right and left signals; and the output right signal is fed to the right sound reproducer, and the output left signal is fed to the left sound reproducer; and wherein the surround signal is delivered to the separate sound reproducer.

5. The stereophonic sound system of claim 4, wherein the stereophonic signals are delivered from the source as digital signals, and further comprising digital-to-analog converters disposed along the output path preceding the three sound reproducers for converting the signals from digital to analog form.

6. The stereophonic sound system of claim 4, further comprising a multiplier for weighting the center signal before the center signal is added to the modified right and modified left signals.

7. The stereophonic sound system of claim 6, further comprising a control unit for delivering a multiplication factor to the multiplier for determining the weighting of the center signal.

8. The stereophonic sound system of claim 4, further comprising a sound intermediate frequency stage for delivering signals to the source, wherein the sound intermediate frequency stage produces signals selected from the group consisting of stereo mulitplex signals and signals with genuine three-dimensional components.

9. The stereophonic sound system of claim 4, wherein the sound reproducers comprise loudspeakers.

10. A stereophonic sound system for conveying an improved three-dimensional sound impression, comprising a source for generating stereophonic signals, the stereophonic signals comprising a right signal, a left signal, a center signal, and a surround signal, wherein the center signal and surround signal supplement the right and left signals to convey a three-dimensional sound impression;

a pair of sound reproducers for reproducing the sound impression generated by the stereophonic signals;

a modification circuit for increasing the width of the right and left stereophonic signals before the signals are delivered to the pair of sound reproducers;

wherein all the stereophonic signals are separately delivered from the source so that the signals are falsified as little as possible;

wherein the right and left signals are delivered from the source to the modification circuit, which produces modified right and left signals; the central signal is added to the modified right and left signals to produce new output right and left signals; and wherein the output right and left signals are each fed to one of the pair of sound reproducers; and wherein the surround signal is fed to a filter circuit for forming a pair of pseudostereo signals having right and left components, and wherein the right and left components of the pseudostereo signals are added to the output right and left signals, respectively, before the output right and left signals are each fed to one of the pair of sound reproducers.

11. The stereophonic sound system of claim 10, wherein the stereophonic signals are delivered from the source as digital signals, and further comprising digital-to-analog converters disposed along each output path preceding each of the two sound reproducers for converting the signals from digital to analog form.

12. The stereophonic sound system of claim 10, further comprising a multiplier for weighting the center signal before the center signal is added to the modified right and modified left signals.

13. The stereophonic sound system of claim 12, further comprising a control unit for delivering a multiplication factor to the multiplier for determining the weighting of the center signal.

14. The stereophonic sound system of claim 10, further comprising a sound intermediate frequency stage for delivering signals to the source, wherein the sound intermediate frequency stage produces signals selected from the group consisting of stereo mulitplex signals and signals with genuine three-dimensional components.

15. The stereophonic sound system of claim 10, wherein two signal paths are output from the modification circuit, one output path for carrying the right modified signal and one output path for carrying the left modified signal, and further comprising two adders disposed along each output path, one adder for adding the center signal and one adder for adding the pseudosignal fed from the filter circuit processing the surround signal, wherein the order of the adders in each output signal path is arbitrary.

16. The stereophonic sound system of claim 10, wherein the sound reproducers comprise loudspeakers.

* * * * *